United States Patent [19]

Marsh

[11] 4,172,609

[45] Oct. 30, 1979

[54] FREIGHT CAR DOOR RETARDER AND OPERATING HANDLE

[75] Inventor: Ronald W. Marsh, Michigan City, Ind.

[73] Assignee: Pullman Incorporated, Chicago, Ill.

[21] Appl. No.: 845,101

[22] Filed: Oct. 25, 1977

[51] Int. Cl.[2] ..... E05C 19/00

[52] U.S. Cl. ..... 292/224; 292/DIG. 32

[58] Field of Search ..... 292/224, 165, 232, 226, 292/DIG. 32

[56] References Cited

U.S. PATENT DOCUMENTS

| | | | |
|---|---|---|---|
| 985,433 | 2/1911 | Mink | 292/224 X |
| 1,966,251 | 7/1934 | Ledwenka | 292/224 X |
| 2,077,138 | 4/1937 | Witherly | 292/224 X |
| 2,563,239 | 8/1951 | Hampton | 292/224 X |
| 3,750,433 | 8/1973 | Sanders | 292/165 X |

*Primary Examiner*—Richard E. Moore

*Attorney, Agent, or Firm*—Richard J. Myers

[57] ABSTRACT

A door retarder to prevent movement of an unlocked railway freight door includes a spring urging a braking cam roller into a pivoted braking shoe that engages a door support rail. An operating handle has a double lobe cam to operate a linkage and move the braking cam roller away from the braking shoe to allow the door to move freely into and from a car door opening when the operating handle is rotated from a normal, upright position. When released, the operating handle returns to the normal position for retarding door movement.

19 Claims, 5 Drawing Figures

FREIGHT CAR DOOR RETARDER AND OPERATING HANDLE

BACKGROUND OF THE INVENTION

1. Field of the Invention

This invention pertains to railway freight cars and in particular to a door operating handle and associating mechanism that provides a braking device to retard inadvertent movement of the car door unless the handle is moved from a normal upright position.

2. Description of the Prior Art

Several prior art devices have provided means for retarding movement of freight car doors when in an unlocked or open position. For example, the Howard et al. U.S. Pat. No. 1,390,786 (1921) shows an extensive handle, lever, rod and cam arrangement for retarding door movement. Similarly, the Cookingham et al. U.S. Pat. No. 1,042,326 (1912) also shows a lever and wedge-lock type of linkage arrangement for retarding movement of the door when it is an unlocked or open position. Neither of these devices has met with widespread acceptance because of the elaborate hardware that must be attached to the car door and because of modifications in the door structure required to adapt the door for use with these devices.

SUMMARY OF THE INVENTION

This invention pertains to a door retarder used on railroad freight car doors to prevent movement of the doors when in an unlocked or open position. It is desirable to prevent movement of the doors such as would occur when the doors are unlocked and the car is in transit or being coupled or otherwise bumped in a switching yard. Oftentimes these impacts occur at speeds high enough to cause the freight car to move relative to the door and at times causing the door to run off its support rail causing door damage and/or injury to personnel working in adjacent areas or on the freight cars.

The door retarder disclosed herein may be easily attached to most conventional freight car doors without extensive refitting and without the addition of extensive hardware to make the door compatable with the retarder. This invention provides a door operating handle that is used to pull the door open or push the door closed as required. This operating handle is adapted to extend vertically in a normal, upright position at which time an associated brake shoe is urged by a spring biased roller into contact with a door supporting rail. The amount of force exerted by the brake shoe against the supporting rail may be varied by adjustment of the biasing spring.

The operating handle includes a double lobe cam connected, through a lever linkage, to the spring biased brake shoe in such a fashion as to disengage the brake shoe from the door supporting rail when the door operating handle is moved in either direction from the normal or upright position. The double lobe cam member that rotates in unison with the operating handle has lobes designed to cooperate with a contacting roller follower to urge the handle back into the upright position after it is rotated in either direction to thus always provide automatic braking or retarding of the door as soon as the operating handle is released. Forces which urge the handle back into the normal position are provided by the biasing spring through the lever linkage.

The door braking arrangement is a modular unit that may be assembled away from the car door and easily attached to the car door.

It is an object of this invention to provide a retarder mechanism for a freight car door that will provide automatic braking.

It is another object of this invention to provide a door retarder arrangement having a brake shoe that engages a door supporting rail member through forces exerted by an adjustable spring member.

It is yet another object of this invention to provide a door retarder that includes an operating handle that can be moved from a normal position in either a first and second direction and which will automatically return to the normal or door braking position when the handle is released.

These and other objects of the invention will become apparent to those having ordinary skill in the art with reference to the following drawings, description and appended claims.

DETAILED DESCRIPTION

Figure 1:
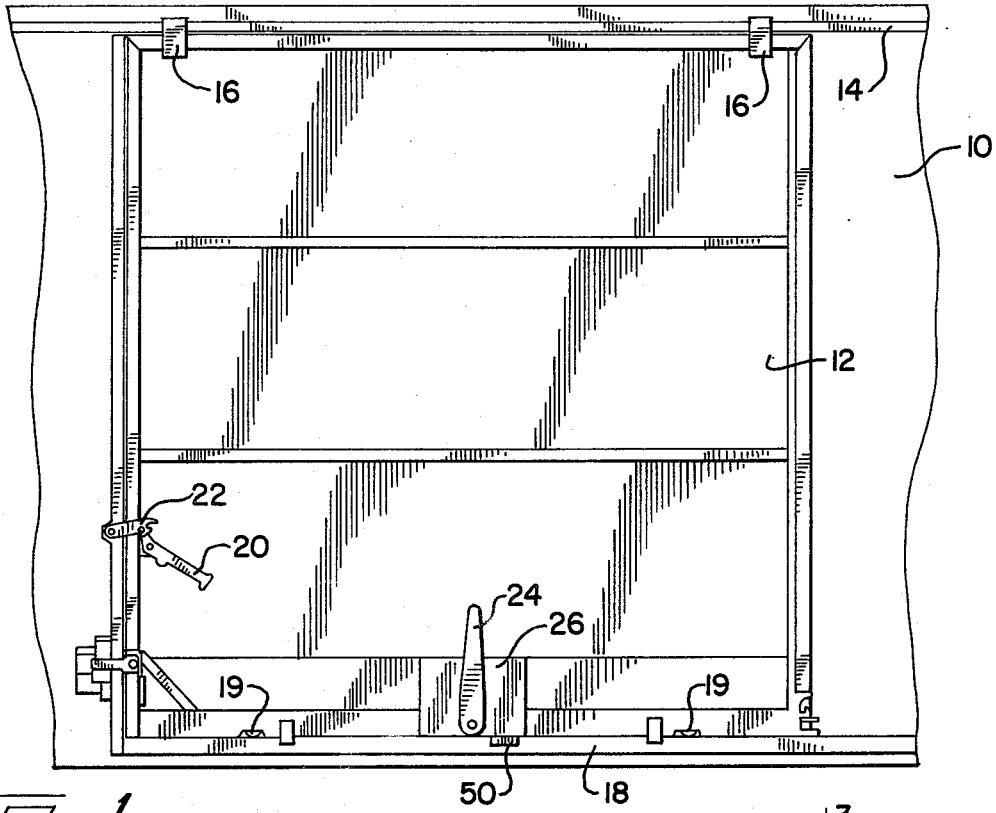
FIG. 1 is a removed side elevational view of a railway freight car and a freight car door.

Referring now to the drawings and in particular to FIG. 1, there is shown an enlarged side portion of a railway freight car 10 having a door 12. The door 12 is guided by a top rail or track 14 which has door-attached hangars 16 extending thereupon. Adjacent the lower portion of the door 12 is a door rail 18 that provides a support for the door and also provides a surface upon which the door rollers 19 move when the door is being opened or closed. Starter closer handle 20 and associated latch 22, which is attached to the door opening framing, may be utilized to initially open or close the door as shown in FIG. 1.

The door retarder and operating mechanism disclosed herein includes an operating handle 24 that is positioned in a normal or upright position as shown in FIG. 1. Cover 26 has side portions attached to back plate 27 and a front extending alongside the handle 24 to provide a unitized enclosure for the retarder components.

Figure 4:
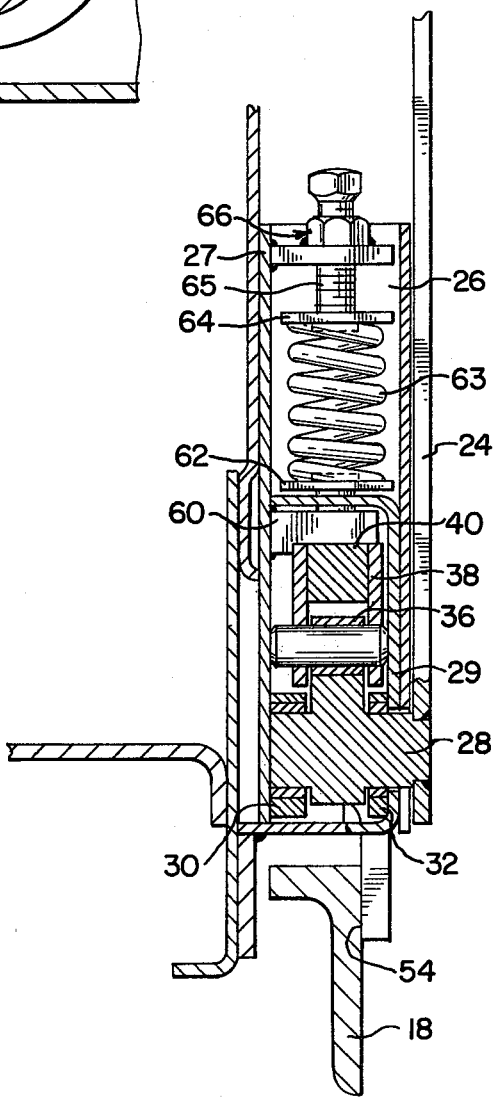
FIG. 4 is another sectional view taken generally along lines 4—4 of FIG. 2.

As shown in FIG. 4, the operating handle 24 is located on the outside of the cover member 26. A double-lobe cam member 28 provides a portion which extends through cover 26 and is attached to the handle 24. The cam and other related mechanism members are located within an internal cam housing 29 that is positioned inside the cover 26.

A double-lobe cam 28 is mounted for rotational movement and includes an inner bearing 30 and an outer bearing 32. Thus, when operating handle 24 is rotated, the cam 28 also rotates.

Cam 28 includes a pair of cam lobes 34, 35 that intersect and provide a dipped or depressed portion into which a follower roller 36 is seated when handle 24 is in an upright, normal position. The follower roller 36 may be in the form of a single cylindrical member or may consist of a needle bearing arrangement suitably sized and fitted around an associated roller shaft 37. The double-lobe cam 28 rotates and moves the follower roller 36 in a linear reciprocating configuration.

Follower roller 36 is positioned within a U-shaped roller mount 38 that forms an integral part of a lift bar 40 (FIG. 2) which has one end pivoted at 42. The other end of lift bar 40 provides a clevis 44 which is U-shaped and depends from the end thereof.

Located within the clevis 44 is a brake roller 46. A roller guide plate 48 is located adjacent the roller 46 to guide the brake roller 46 during vertical movement as viewed in FIG. 3.

Located below the brake roller 46 is a brake 50 having an arcuate cam portion 52 at one end and having a brake shoe portion 54 at the other end adapted to contact the door supporting rail 18. Brake 50 is pivoted at 56.

Figure 2:
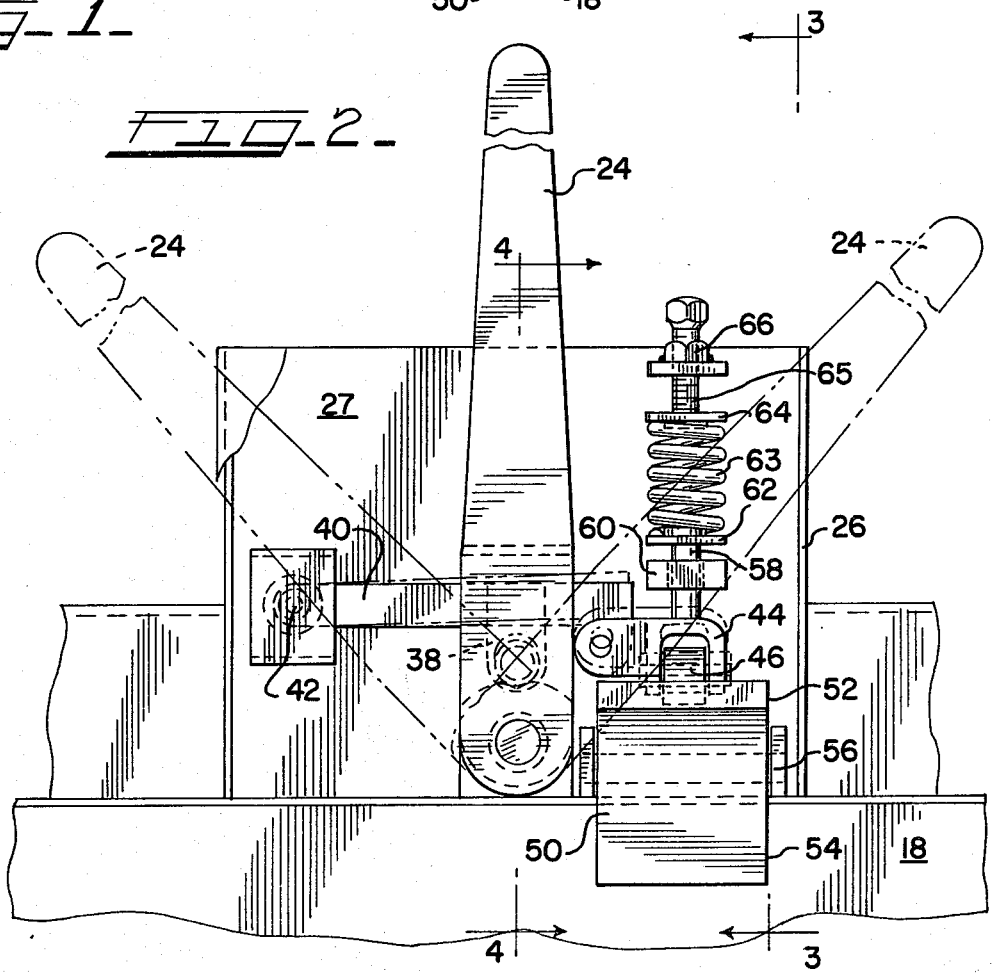
FIG. 2 is an enlarged view of the door retarder shown in FIG. 1 with portions removed for purposes of clarity.
Figure 5:
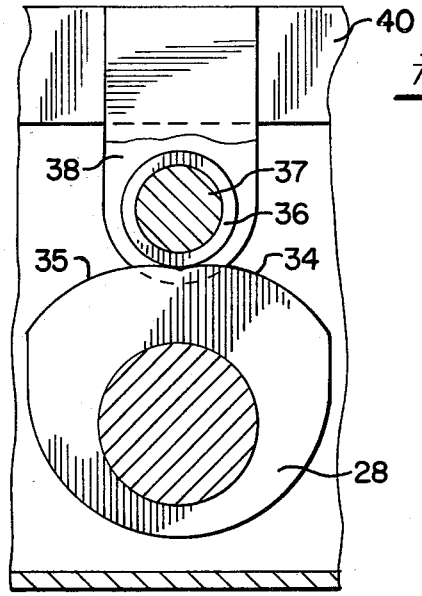
FIG. 5 is an enlarged sectional view of a cam and follower that operate in conjunction with the door operating handle.
Figure 3:
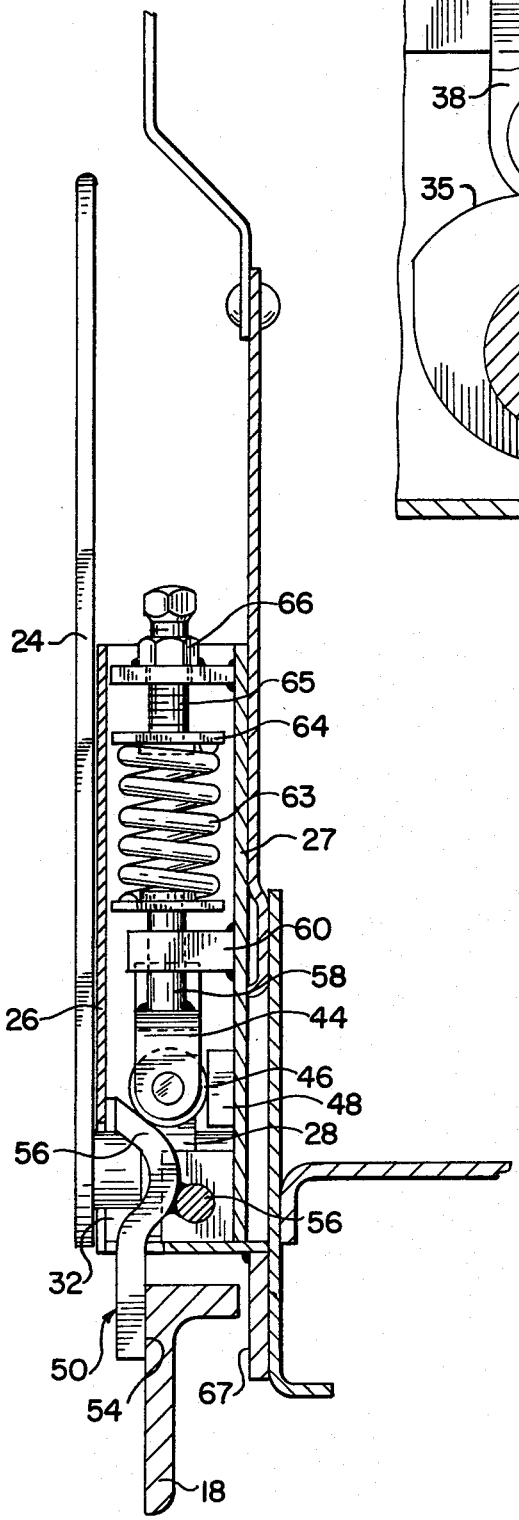
FIG. 3 is a sectional view taken generally along lines 3—3 of FIG. 2.

As shown in FIGS. 2 and 3, clevis 44 has a guide shaft 58 extending upwardly and extends through guide 60. Guide shaft 58 terminates at a spring mounting plate 62 which receives an end portion of a helical spring 63. The top portion of the spring 63 is mounted to a retainer 64. Extending upwardly from the retainer 64 is a threaded adjustment stud 65 that extends through the associated mounting guide 66 which is securely attached to back plate 27. Adjustment stud 65 may be rotated to vary the amount of compression in spring 63 to thereby vary the braking or retarding force applied between the brake shoe portion 54 and rail 18. As shown in FIGS. 2–4, spring 63 is compressed between plates 62 and retainer 64 and provides a constant downward force on brake roller 46 and the associated cam portion 52.

OPERATION

In operation, it is noticed that when operating the handle 24 is in the upright or normal position as shown in FIG. 2, the mechanism will be in a configuration shown in FIG. 3. That is, with the operating handle 24 upright, brake roller 46 is urged downwardly by spring 63. When urged downwardly, roller 46 is wedged between guide plate 48 and cam portion 52 of the brake 50. This wedging produces a pivotal movement of the brake 50 about pivot member 56, pivoting the brake shoe 54 into contact with the door track 18 to produce a frictional force that retards undesirable movement of the car door 12. When the brake shoe portion 54 contacts the rail 18 the rail 18 is caught between the brake shoe 54 and a door-attached wear plate 67. The gripping of rail 18 between plate 67 and the brake shoe portion 54 produces an effective braking force to hold the door 12 in position.

Referring now to FIG. 2 it is noticed that rotation of the operating handle 24 in a clockwise or in a counterclockwise position causes the associated cam member 28 to rotate and raise the follower roller 36. Upward movement of roller 36 causes lift bar 40 to move about pivot 42 and in turn raise the clevis 44.

Because the spring 63 is installed and adjusted as a compression spring, it is always urging the associated brake roller 46 downwardly which also urges follower roller 36 downwardly on the cam member 38. Cam lobes 34, 35 are contoured to produce a moment that tends to return the operating handle 24 to the normal upright position of FIG. 1 when the handle is released after being rotated in either direction shown in FIG. 2.

With the automatic braking arrangement provided by the cam 28 in conjunction with the spring 63 and lever 40, the door retarding or braking feature is always present unless manually removed by rotating handle 24. This arrangement produces an inherent safety feature of always having the car door 12 retarded when not being moved manually.

The foregoing description and drawings merely explain and illustrate the invention and the invention is not limited thereto, except insofar as the appended claims are so limited, as those who are skilled in the art and have the disclosure before them will be able to make modifications and variations therein without departing from the scope of the invention.

What is claimed is:

1. A door retarder for use on a railway freight car to prevent undesirable movement of a freight car door relative to the car body when in an unlocked or open position comprising:

brake means for attachment to the bottom portion of the door with brake shoe means adapted to contact said freight car body;

biasing means for urging the brake means into engagement with said freight car body;

an operating handle having a normal position and being movable to a second position;

cam means rotatable with the handle;

follower roller means operatively engageable with the cam means;

lever means operatively connected to the follower roller means;

said lever means having end means connected with said biasing means for urging the follower roller means into engagement with the cam means;

said lever means responsive to movement of said handle from the normal position for releasing the brake shoe means from braking contact with the freight car to permit the door to be manually moved.

2. The door retarder of claim 1 wherein said cam means includes:

a double-lobe cam member having first and second cam portions that intersect and provide a seat for the follower roller means when the operating handle is in the normal position;

said first and second cam portions having means to provide a moment for returning said operating hand to the normal position from said second position when urged by the follower roller.

3. The door retarder of claim 1 wherein said brake means includes:

a pivoted plate member having a cam portion spaced from said brake shoe means.

4. The door retarder of claim 1 wherein said end means of said lever includes:

a clevis;

said clevis having a first portion connected with the lever and having a second portion engaging the means urging the brake shoe into engagement with said freight car.

5. The door retarder of claim 1 wherein said biasing means for urging the brake means into engagement with the freight car includes:

a spring;

a brake roller;

a guide shaft operatively attached to the spring means and having means engaging the brake roller.

6. The door retarder of claim 5 wherein said biasing means includes:

adjustment stud means for moving said spring and thereby adjusting the spring force exerted on the brake roller and the brake means.

7. The door retarder of claim 5 and:

means for guiding the brake roller into a controlled contact with the brake means whereby the brake means is pivotally urged into engagement with a portion of the freight car for braking movement of the freight car door.

8. The door retarder of claim 7 wherein said means for guiding the brake roller includes:

a guide plate member adapted to abut and control reciprocating movement of the brake roller.

9. A door retarder for use on a railway freight car to prevent movement relative to the car body of a freight car door when unlocked comprising:

brake means adapted to be mounted on said door and to frictionally engage said freight car body;

biasing means operatively engaging and urging said brake means into engagement with said freight car body;

cammed means operatively connected with said biasing means;

cam means operatively engaging said cammed means; and operating means operatively rotatably connected to said cam means and operable to rotate said cam means from a first position to a second position, whereby said cammed means operate in opposition to said biasing means to disengage said brake means from engagement with said car body.

10. The invention in accordance with claim 9, said cammed means including:

lever means having a first end and a second end, said lever means being pivoted for rotation about said first end;

follower means mounted on said lever between the first and second ends thereof and adapted to operatively engage said cam means;

said second end of said lever being operatively connected to said biasing means.

11. The invention in accordance with claim 9, said cam means including:

a double-lobe cam member having first and second cam portions that intersect and provide a seat for said cammed means when said cam means are in said first position;

said first and second cam portions having means to provide a moment for returning said cam means to said first position from said second position when urgedly acted upon by said cammed means.

12. The invention in accordance with claim 9, said biasing means including:

spring means;

brake roller means;

guide means operatively attached to said spring means and said roller means whereby said spring means urge said roller means into engagement with said brake means.

13. The invention in accordance with claim 12, and adjustment means adapted to move said spring means whereby the spring force exerted upon said roller means may be varied.

14. The invention in accordance with claim 12, said brake means having a pivotally mounted brake element having first and second portions;

said first portion adapted to frictionally engage said car body; and said second portion adapted to be operatively engaged by brake roller means.

15. In a railway freight car having a car body and a door carried by said body for sliding movement relative thereto, a door retarder to prevent movement of said door relative to said body comprising:

brake means mounted on said door and adapted to frictionally engage said car body;

biasing means operatively engaging and urging said brake means into engagement with said freight car body;

lever means connected to said biasing means;

cammed means mounted on said lever means;

cam means rotatable between a first and second position;

operating means connected with said cam means for rotation from said first position to said second position, whereby said cam means and said cammed means operatively engage to urge said lever means in opposition to said biasing means to release said brake means from engagement with said car body.

16. The invention in accordance with claim 15, said cammed means having follower means mounted on said lever in operative engagement with said cam means.

17. The invention in accordance with claim 15, said cam means including:

a double-lobe cam member having a pair of cam portions that intersect to provide a seat for said cammed means when said cam means are in said first position;

said cam portions having means to provide a moment for returning said cam means to said first position from said second position when urgedly engaged by said cammed means.

18. The invention in accordance with claim 15, said biasing means including:

roller means for engaging and urging said brake means into frictional engagement with said car body;

spring means operatively connected with said roller for urging said roller means into engagement with brake means.

19. The invention in accordance with claim 18, said spring means being operatively connected with said lever means for urging said cammed means into operative engagement with said cam means.

* * * * *